US009382061B2

(12) United States Patent
Ruman

(10) Patent No.: US 9,382,061 B2
(45) **Date of Patent: *Jul. 5, 2016**

(54) DISCREET PACKAGING FOR PERSONAL CARE PRODUCTS

(71) Applicant: Kimberly-Clark Worldwide, Inc., Neenah, WI (US)

(72) Inventor: Marcille Faye Ruman, Oshkosh, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/521,256

(22) Filed: Oct. 22, 2014

(65) Prior Publication Data

US 2015/0041362 A1 Feb. 12, 2015

Related U.S. Application Data

(62) Division of application No. 14/138,594, filed on Dec. 23, 2013, which is a division of application No. 13/546,380, filed on Jul. 11, 2012, now Pat. No. 8,640,870, which is a division of application No. 12/316,739, filed on Dec. 16, 2008, now Pat. No. 8,225,930.

(51) Int. Cl.

| | |
|---|---|
| ***B65D 25/34*** | (2006.01) |
| ***B65D 85/00*** | (2006.01) |
| ***B65D 5/62*** | (2006.01) |

(52) U.S. Cl.

CPC *B65D 85/00* (2013.01); *B65D 5/62* (2013.01); *B65D 25/34* (2013.01)

(58) Field of Classification Search

CPC ..... B65D 25/34; B65D 5/62; B65D 85/00; A61F 13/20; A61F 13/2077; G09F 3/00

USPC ..... 206/440, 459.5, 459.1, 457, 736; 150/154; 229/922; 604/358

See application file for complete search history.

(56) References Cited

U.S. PATENT DOCUMENTS

| | | | |
|---|---|---|---|
| 1,628,121 | A | 5/1927 | Edwin |
| 2,919,829 | A | 1/1960 | Forrer |

(Continued)

FOREIGN PATENT DOCUMENTS

| | | | |
|---|---|---|---|
| EP | 0 986 996 | A2 | 3/2000 |
| FR | 2 785 872 | A1 | 5/2000 |
| GB | 2 332 897 | A | 7/1999 |

*Primary Examiner* — Steven A. Reynolds

(74) *Attorney, Agent, or Firm* — Kimberly-Clark Worldwide, Inc.

(57) ABSTRACT

A packaging system for personal care products is provided including a package including an external surface and a package circumference, and a concealment element circumscribing the package at the package circumference and being positionable between a first position in which the packaging system exhibits product-identifying graphics and a second position in which the packaging system is substantially bereft of product-identifying graphics. Also provided is a packaging system including a package including an external surface including a first portion with a desired nondescript aesthetic configuration that is generally not indicative of the personal care products within the package and a second portion with product-identifying graphics, a concealment element variably positionable on the external surface of the package, and necessary purchasing indicia provided on one of the package and the concealment element at a location such that the purchasing indicia are visible when the concealment element is in the second position.

9 Claims, 9 Drawing Sheets

(56) References Cited

U.S. PATENT DOCUMENTS

| | | | | |
|---|---|---|---|---|
| 3,918,631 | A | 11/1975 | Hackenberg | |
| 4,890,763 | A | 1/1990 | Curiel | |
| 4,955,469 | A | 9/1990 | Hudspith | |
| 5,117,841 | A * | 6/1992 | McBeth | 128/844 |
| 5,673,796 | A | 10/1997 | Tulloch | |
| 5,730,294 | A | 3/1998 | Blosser et al. | |
| 5,809,674 | A | 9/1998 | Key | |
| 6,086,697 | A | 7/2000 | Key | |
| 6,129,802 | A | 10/2000 | Key | |
| 6,212,803 | B1 | 4/2001 | Key | |
| 6,237,269 | B1 | 5/2001 | Key | |
| 6,260,756 | B1 | 7/2001 | Mochizuki et al. | |
| 6,385,878 | B1 | 5/2002 | Key | |
| 6,454,095 | B1 * | 9/2002 | Brisebois et al. | 206/494 |
| 6,601,705 | B2 | 8/2003 | Molina et al. | |
| 6,601,706 | B2 | 8/2003 | McManus et al. | |
| 6,631,578 | B2 | 10/2003 | Key | |
| 6,669,021 | B1 * | 12/2003 | Spielman | 206/457 |
| 6,688,466 | B2 | 2/2004 | White et al. | |
| 7,087,298 | B2 | 8/2006 | Key | |
| 7,172,073 | B2 | 2/2007 | Hanson | |
| 7,172,668 | B2 | 2/2007 | Key | |
| 7,325,686 | B2 * | 2/2008 | Aldridge | 206/460 |
| 7,523,825 | B2 | 4/2009 | Velazquez et al. | |
| 8,066,186 | B2 * | 11/2011 | Kidwell | 235/462.01 |
| 8,146,742 | B2 * | 4/2012 | Kumasaka | 206/440 |
| 2002/0148749 | A1 | 10/2002 | Briseboi et al. | |
| 2003/0102238 | A1 * | 6/2003 | White et al. | 206/438 |
| 2004/0045857 | A1 | 3/2004 | Gillani | |
| 2004/0155453 | A1 | 8/2004 | Ross | |
| 2005/0098466 | A1 * | 5/2005 | Thomas | 206/440 |
| 2005/0137940 | A1 * | 6/2005 | Lindsay | 705/26 |
| 2006/0032782 | A1 | 2/2006 | Suh et al. | |
| 2007/0045144 | A1 * | 3/2007 | Wheeler et al. | 206/494 |
| 2007/0090014 | A1 | 4/2007 | Wheeler et al. | |
| 2007/0144929 | A1 | 6/2007 | Minerath, III et al. | |
| 2007/0267322 | A1 | 11/2007 | Kishida et al. | |
| 2008/0041755 | A1 | 2/2008 | Noschang et al. | |
| 2009/0065560 | A1 | 3/2009 | Johnson | |
| 2009/0120816 | A1 | 5/2009 | Ruman et al. | |
| 2009/0120825 | A1 | 5/2009 | Ruman et al. | |
| 2009/0124990 | A1 | 5/2009 | Feldkamp et al. | |
| 2009/0188210 | A1 | 7/2009 | Blocker | |
| 2009/0301921 | A1 * | 12/2009 | Kidwell | 206/459.5 |
| 2010/0276307 | A1 * | 11/2010 | Kumasaka | 206/216 |
| 2011/0266183 | A1 | 11/2011 | Boon et al. | |
| 2012/0043246 | A1 | 2/2012 | Kidwell et al. | |

* cited by examiner

DISCREET PACKAGING FOR PERSONAL CARE PRODUCTS

PRIORITY

This application is a divisional of application Ser. No. 12/316,739 entitled Discreet Packaging for Personal Care Products and filed in the U.S. Patent and Trademark Office on Dec. 16, 2008, and now U.S. Pat. No. 8,225,930 which issued on Jul. 24, 2012 and application Ser. No. 13/546,380 entitled Discreet Packaging for Personal Care Products, filed in the U.S. Patent and Trademark Office on Jul. 11, 2012, and now U.S. Pat. No. 8,640,870 which issued on Feb. 4, 2014, and application Ser. No. 14/138,594 entitled Discreet Packaging for Personal Care Products and filed in the U.S. Patent and Trademark Office on Dec. 23, 2013. The entirety of the prior applications is hereby incorporated by reference in this application.

BACKGROUND

The present disclosure relates to packaging of personal care products, and in particular to a packaging system that offers a greater degree of privacy and discreetness to consumers.

Personal care products are generally known in the art as products of a personal hygiene or health care nature. Such products include, for example, incontinence articles, enuresis articles, diapers, feminine hygiene products, etc. These products are typically packaged so that there is no question to the consumer as to what the package contains. Additionally, certain product information must be displayed on the package and be clearly visible to consumers. Unfortunately, conventional packaging also announces to everyone else at the point of purchase exactly what articles the consumer is purchasing. As a result, the purchasing of such products can be an embarrassing, anxious, and often traumatic experience for certain individuals. Consumers might rush to obscure the personal care products they are buying with other items in their cart as they shop. Alternately, consumers might purposefully shop at non-peak periods so fewer people will see them buying personal care products.

The storage of personal care products can also be problematic. Most individuals value their personal privacy and prefer not to advertise to others in their living quarters that personal care products are present or necessary. However, in relatively tight or cramped living quarters (i.e., small apartments, college dorms, recreational vehicles, campers, etc.) cabinet or closet storage space is often unavailable in which to "hide" personal care products and it is often necessary that such products are stored in plain view. This situation can be embarrassing and distressing. In addition, hindered accessibility to personal care products is not necessarily desirable, especially when the product needs to be changed multiple times a day.

Further, discretion can be advantageous for disposal of packaging as well. Consumers generally do not want even an empty box of incontinence products sitting on the curb for all to see. Finally, some products of the types described herein are available through home healthcare providers and other on-line retailers. The ability to provide discreet packaging for shipment and delivery in such contexts is also desirable. For example, a retailer can remove/conceal packaging graphics prior to shipping to allow for discretion.

An opportunity exists to provide personal care product packaging that addresses the need for enhanced discretion.

Consumers are embarrassed to be seen purchasing incontinence, enuresis, or feminine care products and having the products be seen at home.

A need thus exists in the art for a discreet packaging system that disguises or hides the fact that personal care products are contained within the package yet does not detract from the purchasing individual's ability to accurately discern and identify the product at the point of sale or purchase.

SUMMARY

Objects and advantages of the present disclosure will be set forth in part in the following description, or can be obvious from the description, or can be learned through practice of the present disclosure.

The disclosure herein addresses this need by providing a packaging design in which the consumer can selectively alter the product's graphics to conceal the identity of the contents. The concealment method can be performed at the point of sale when the product is pulled from the shelf and can remain intact during product dispensing. The packaging system can be used for packaging any type of personal care product, for example incontinence articles, enuresis products, or feminine pads, and has particular usefulness for packaging feminine hygiene products, including sanitary pads, liners, tampons, etc. All such uses are within the scope and spirit of the present disclosure.

The packaging system for personal care products according to the present disclosure includes a package configured for receipt of personal care products therein, the package including an external surface and a package circumference, and a concealment element circumscribing the package at the package circumference and being positionable between a first position in which the packaging system exhibits product-identifying graphics and a second position in which the packaging system is substantially bereft of product-identifying graphics.

In another aspect of the present disclosure, the packaging system includes a package configured for receipt of personal care products therein, the package including an external surface including a first portion with a desired nondescript aesthetic configuration that is generally not indicative of the personal care products within the package and a second portion with product-identifying graphics. The packaging system also includes a concealment element variably positionable on the external surface of the package, the concealment element positionable between a first position in which the packaging system exhibits product-identifying graphics and a second position in which the packaging system exhibits an aesthetic surface configuration that generally conforms to that of the second portion of the package external surface. Finally, the packaging system also includes necessary purchasing indicia provided on one of the package and the concealment element at a location such that the purchasing indicia are visible when the concealment element is in the second position.

The packaging system according to the description will be described in greater detail below through use of the appended figures.

The purposes and features of the present disclosure will be set forth in the description that follows. Additional features of the disclosure might be realized and attained by the product and processes particularly pointed out in the written description and claims hereof, as well as from the appended drawings.

It is to be understood that both the foregoing general description and the following detailed description are exemplary and are intended to provide further explanation of the disclosure claimed. The accompanying drawings, which are incorporated in and constitute part of this specification, are included to illustrate and provide a further understanding of the disclosure.

BRIEF DESCRIPTION OF THE DRAWINGS

The present disclosure will be more fully understood, and further features will become apparent, when reference is made to the following detailed description and the accompanying drawings. The drawings are merely representative and are not intended to limit the scope of the claims.

Figure 1:
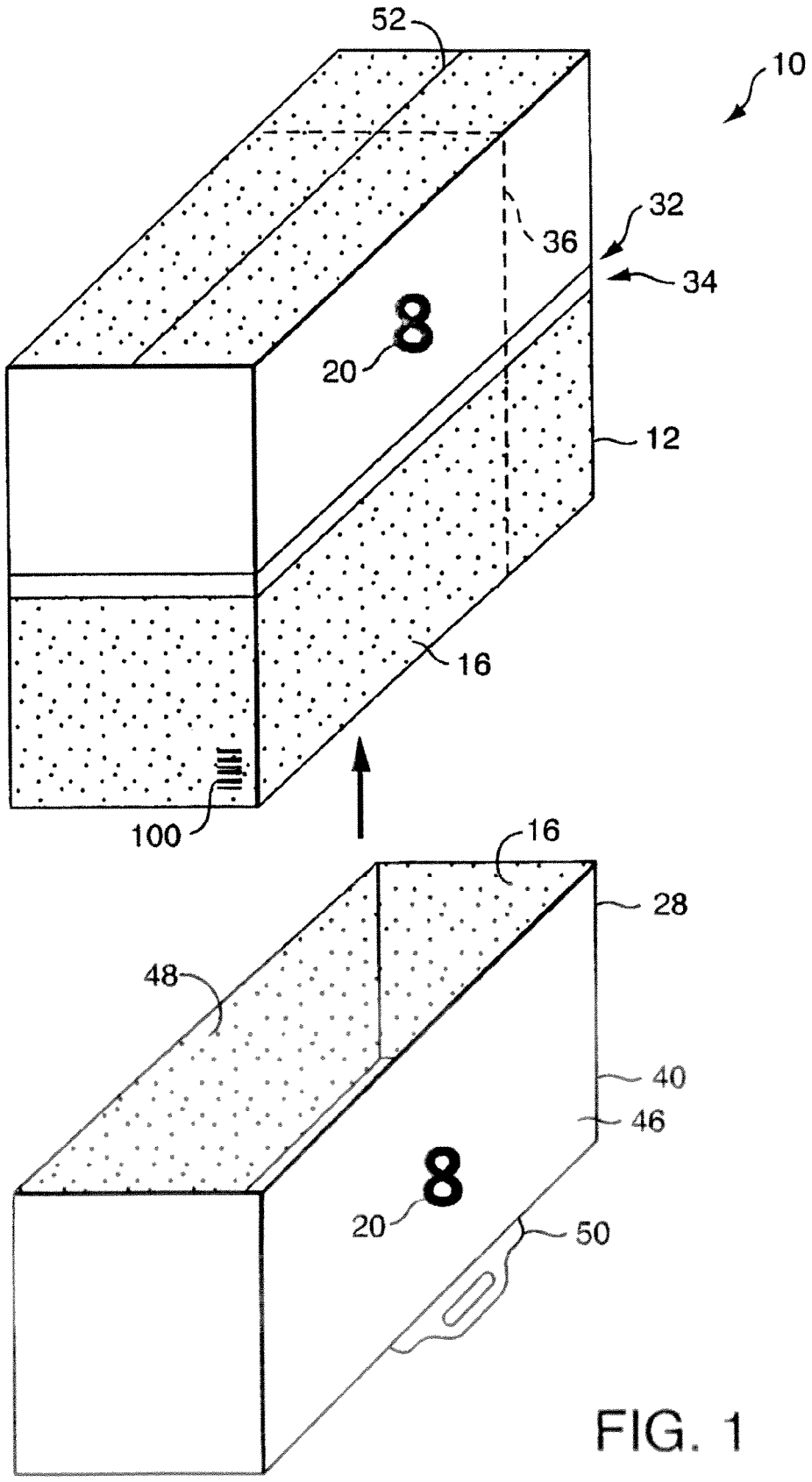
FIG. 1 is a representative perspective view of a packaging system of the present disclosure illustrating a skirt concealment element.

Repeat use of reference characters in the present specification and drawings is intended to represent the same or analogous features or elements of the present disclosure. The drawings are representational and are not necessarily drawn to scale. Certain proportions thereof might be exaggerated, while others might be minimized.

DETAILED DESCRIPTION

Reference will now be made in detail to one or more aspects of the present disclosure as illustrated in the figures. Each aspect is provided by way of explanation of the present disclosure, and not meant as a limitation of the present disclosure. For example, features illustrated or described as part of one aspect can be used with another aspect to yield still a further aspect. It is intended that the present disclosure covers these and other modifications and variations as come within the scope and spirit of the present disclosure.

The present disclosure addresses the desire for enhanced discretion during both the purchase experience and during consumption. Current incontinence product packaging typically consists of an opaque plastic bag with welded seams at opposite ends and having printed graphics on the exterior that identify the contents of the package. The present disclosure includes a positionable concealment element that can be positioned over the package to selectively obscure the retail graphics when desired.

FIG. 1 illustrates a packaging system, generally 10, for personal care products according to the present disclosure. It should be appreciated that the packaging system 10 is not limited in use to any particular type of personal care product. The packaging system 10 is illustrated as a packaging system 10 for incontinence articles in that this is a particularly useful application of the disclosure. However, the packaging system 10 is just as useful for other types of personal care products, including feminine care products, such as pads, liners, tampons, etc., enuresis articles, diapers, etc. The packaging system 10 includes a package 12 configured for receipt of personal care products therein. The package 12 can take on any manner of conventional package, such as the box or carton illustrated in FIGS. 1-9. In an alternative aspect, the package 12 can be a soft-side package. The package 12 can be made of any suitable material including rigid plastic, plastic film, nonwoven material, or corrugate. These types of packages 12 are well known and used in the industry and a detailed description thereof is not necessary for purposes of understanding the present disclosure.

The package 12 includes an external surface having a visible nondescript aesthetic surface configuration, generally 16, over at least a portion thereof. This nondescript aesthetic surface configuration 16 is "nondescript" in that it does not advertise or otherwise give an indication of the personal care products contained within the package 12. For example, in the aspects illustrated in FIGS. 1-9, the nondescript aesthetic surface configuration 16 is a dotted pattern. It should be appreciated that any combination of patterns, colors, etc. can be used in this regard to provide a generally pleasing and nondescript aesthetic surface configuration 16 for the package 12.

The package 12 can include product-identifying graphics 20 thereon at a location that will be covered upon repositioning of a concealment element 28, as described below. Product identifying graphics 20 can include the type of personal care product disposed in the package 12, the size or sizes of personal care products disposed in the package 12, and the count, amount, or volume of personal care products disposed in the package 12, all as applicable to the type of personal care products. Product identifying graphics 20 can also include the manufacturer, customer service information, use instructions, patent markings, and any other information typically disposed on a package of personal care products, or any information that can be included to help a shopper identify and select the appropriate product on the shelf.

The package 12 also includes a package circumference 32 that can be any perimeter at a given horizontal or vertical position of the package 12. FIG. 1 illustrates a horizontal circumference 34 and a vertical circumference 36. The horizontal circumference 34 is generally the distance around the package 12 on a horizontal plane, such as the perimeter of a lower face of the package 12. The vertical circumference 36 is generally the distance around the package 12 on a vertical plane, such as across the upper and lower faces and across the front and back of the package 12. A package circumference 32 can be dimensionless in a direction perpendicular to the plane of the package circumference 32, or the package circumference 32 can have a thickness up to and including the height or width of the package 12.

The packaging system 10 includes a concealment element 28 that is associated with but variably positionable on the package 12. The concealment element 28 circumscribes the package 12 at the package circumference 32. The concealment element 28 can be affixed to the package 12 using adhesive, welding, or other suitable means, or the concealment element 28 can be positioned on the package 12 and held in place due to a friction fit with the package 12.

The concealment element 28 is positionable between a first position in which the packaging system 10 exhibits product identifying graphics 20 and a second position in which the packaging system 10 is substantially bereft of product identifying graphics 20, and instead exhibits a nondescript aesthetic surface configuration 16. In general, the first position of the concealment element 28 allows product identifying graphics 20 on the package 12 to be visible, and the concealment element 28 can itself include product identifying graphics 20. Similarly, the second position of the concealment element 28 generally allows a nondescript aesthetic surface configuration 16 on one or both of the package 12 and the concealment element 28 to be visible. These positions are described in more detail below.

Figure 2:
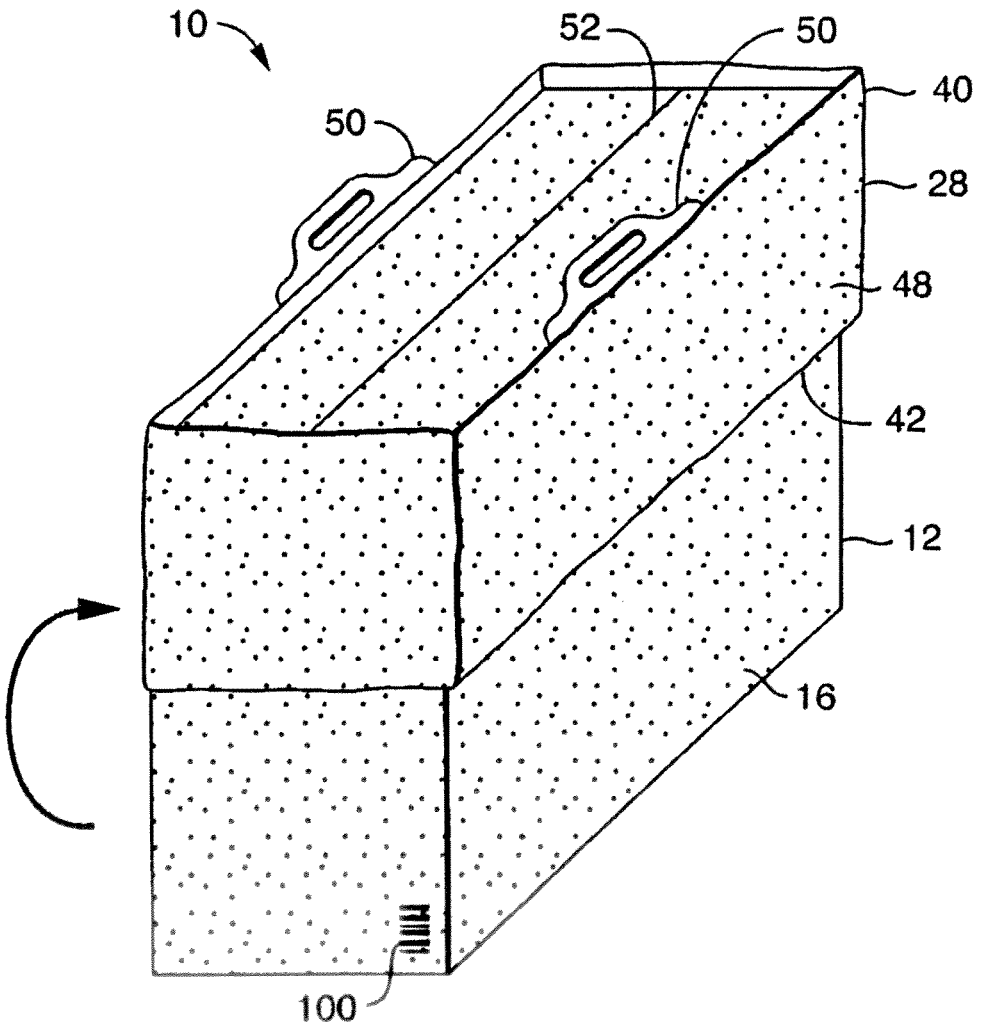
FIG. 2 is a representative perspective view of the packaging system of FIG. 1 particularly illustrating the repositionable concealment element.

The positionable concealment element 28 can be accomplished in various ways. In the aspect illustrated in FIGS. 1 and 2, the concealment element 28 is a skirt 40 connected to the exterior surface of the package 12 at a horizontal package circumference 34. In the illustrated aspect, the package circumference 32 is located approximately midway along the height of the package 12, although any other suitable configuration 16 can be used. The nature of the connection between the skirt 40 and the package 12 forms a package circumference fold 42 that allows the skirt 40 to hingedly move or invert between a downward position and an upward position, as shown in FIGS. 1 and 2.

In this aspect, the concealment element 28 has a first side 46 that can have any manner of product identifying graphics 20 printed thereon. Such product identifying graphics 20 can be the sole product identifying graphics 20 on the packaging system 10 or can be in addition to any product identifying graphics 20 on the package 12. The product identifying graphics 20 on the first side 46 of the concealment element 28 can be a continuation of the product identifying graphics 20 on the package 12. The totality of the product identifying graphics 20 adequately describes and identifies the personal care products contained within the package 12. Referring to FIG. 1, the concealment element 28 is positionable on the package 12 in a first position such that the first side 46 is outwardly facing and any product identifying graphics 20 are readily visible to a potential consumer. The concealment element 28 is held against the exterior surface of the package 12 in the first position by the friction fit caused by the circumscription of the concealment element 28 about the package 12.

Further to this aspect, the concealment element 28 has an opposite or second side 48 having a nondescript aesthetic surface configuration 16 thereon. As with the nondescript aesthetic surface configuration 16 of the package 12, the nondescript aesthetic surface configuration 16 of the second side 48 can be any pattern, color, etc. that provides a generally pleasing aesthetic visual appearance without giving any noticeable indication of the personal care products carried within the package 12. Referring to FIG. 2, the concealment element 28 is positionable on the package 12 by a consumer to the second position by sliding the unattached end of the skirt 40 along the package 12, hinging on the package circumference fold 42, such that the second side 48 is outwardly facing and any product identifying graphics 20 are hidden from the consumer and any others who might see the package 12. Again, the concealment element 28 is held against the exterior surface of the package 12 in the second position by the friction fit caused by the circumscription of the concealment element 28 about the package 12.

In this aspect, positioning of the skirt 40 by the consumer, and transport of the package 12, can be aided by the addition of one or more handles 50 to the unattached end of the skirt 40. The handles 50 can be folded up, down, or in as desired and further can be removably attached to the package 12 or the concealment element 28 using light adhesive or by other suitable means if desired.

To configure the packaging system 10 for discretion, a consumer can conceal the contents of the package 12 by inverting the skirt 40 by grasping the package 12 and the handle 50 or the unattached end of the skirt 40 and inverting the skirt over the package 12. As this is done, the nondescript aesthetic surface configuration 16 of the skirt 40 is revealed to match the nondescript aesthetic surface configuration 16 on the package 12. A zippered or perforated opening 52 can be located at the top of the package 12, immediately below the unattached end or the handles 50 with the skirt 40 in the second position, to allow product dispensing with or without the skirt 40 inverted.

Figure 3:
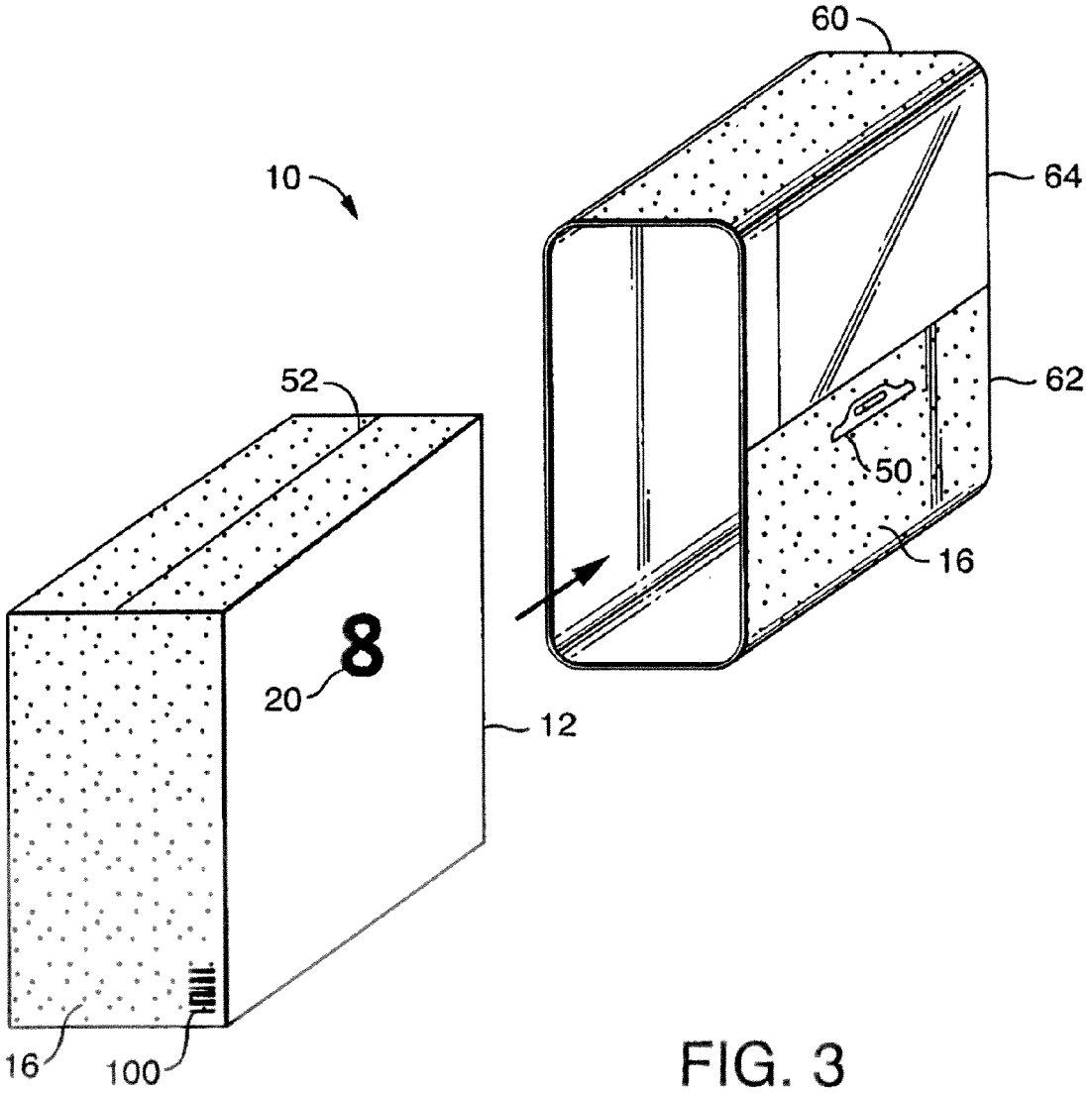
FIG. 3 is a representative perspective view of the packaging system of the present disclosure illustrating a rotatable sleeve concealment element.
Figure 4:
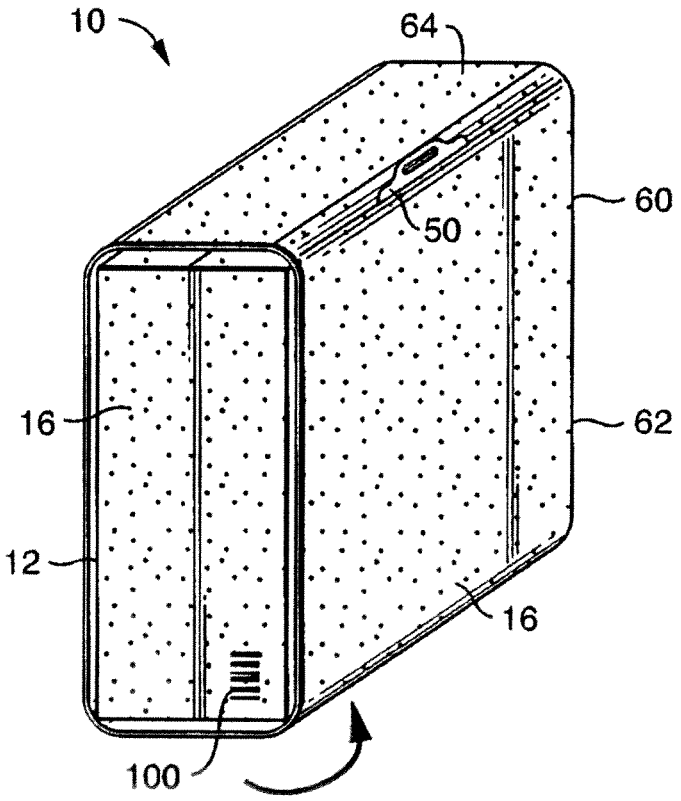
FIG. 4 is a representative perspective view of the packaging system of FIG. 3 particularly illustrating the repositionable concealment element.

In another aspect of the present disclosure illustrated in FIGS. 3 and 4, the concealment element 28 is a tubular sleeve 60 that is open on two ends. The sleeve 60 is slid over the package 12 to circumscribe the exterior surface of the package 12 and is held in place by a friction fit with the package 12. The sleeve 60 is positionable by slidably rotating the sleeve 60 about the package 12 along a package circumference 32. In the illustrated aspect, the sleeve 60 extends along the width of the package 12 in a vertical configuration, but the sleeve 60 can extend less than or beyond the width of the package 12, or can be positioned in a horizontal configuration. Any other suitable configuration can be used.

In this aspect, the sleeve 60 has an opaque section 62 and a window 64 typically made from opaque and clear films, respectively, such that, in any position, the sleeve 60 obscures parts of the package 12 and allows viewing of other parts of the package 12. To complement the sleeve 60, the package 12 has alternating portions of product identifying graphics 20 and of a nondescript aesthetic surface configuration 16. The opaque section 62 of the sleeve 60 typically includes a nondescript aesthetic surface configuration 16. In addition, the sleeve 60 can be temporarily secured to the package 12 for transport and retail sale using breakable or perforated tape, adhesive, or any other suitable means.

To configure the packaging system 10 for retail sales, the sleeve 60 is positioned such that the window 64 of the sleeve 60 is aligned to overlie the product identifying graphics 20 on the package 12 while the opaque section 62 of the sleeve 60 overlies the nondescript aesthetic surface configuration 16 of the package 12.

To configure the packaging system 10 for discretion, a consumer simply holds the side of the package 12 and pulls or slides the sleeve 60 around the package 12. A handle 50 attached to the sleeve 60 can facilitate movement of the sleeve 60, particularly if the handle 50 is positioned such that the handle 50 reaches the top of the package 12 when the sleeve 60 is in the second position. As the sleeve 60 is being positioned by the consumer, the sleeve 60 rotates around the package 12, allowing the opaque section 62 of the sleeve to cover the product identifying graphics 20 on the package 12, thus concealing the nature of the products in the package 12. Re-positioning the sleeve 60 can also allow the nondescript aesthetic surface configuration 16 of the package 12 to become visible in the window 64 of the sleeve 60. A zippered or perforated opening 52 can be located on any accessible side of the package 12 to allow product dispensing with or without the sleeve 60 attached.

Figure 5:
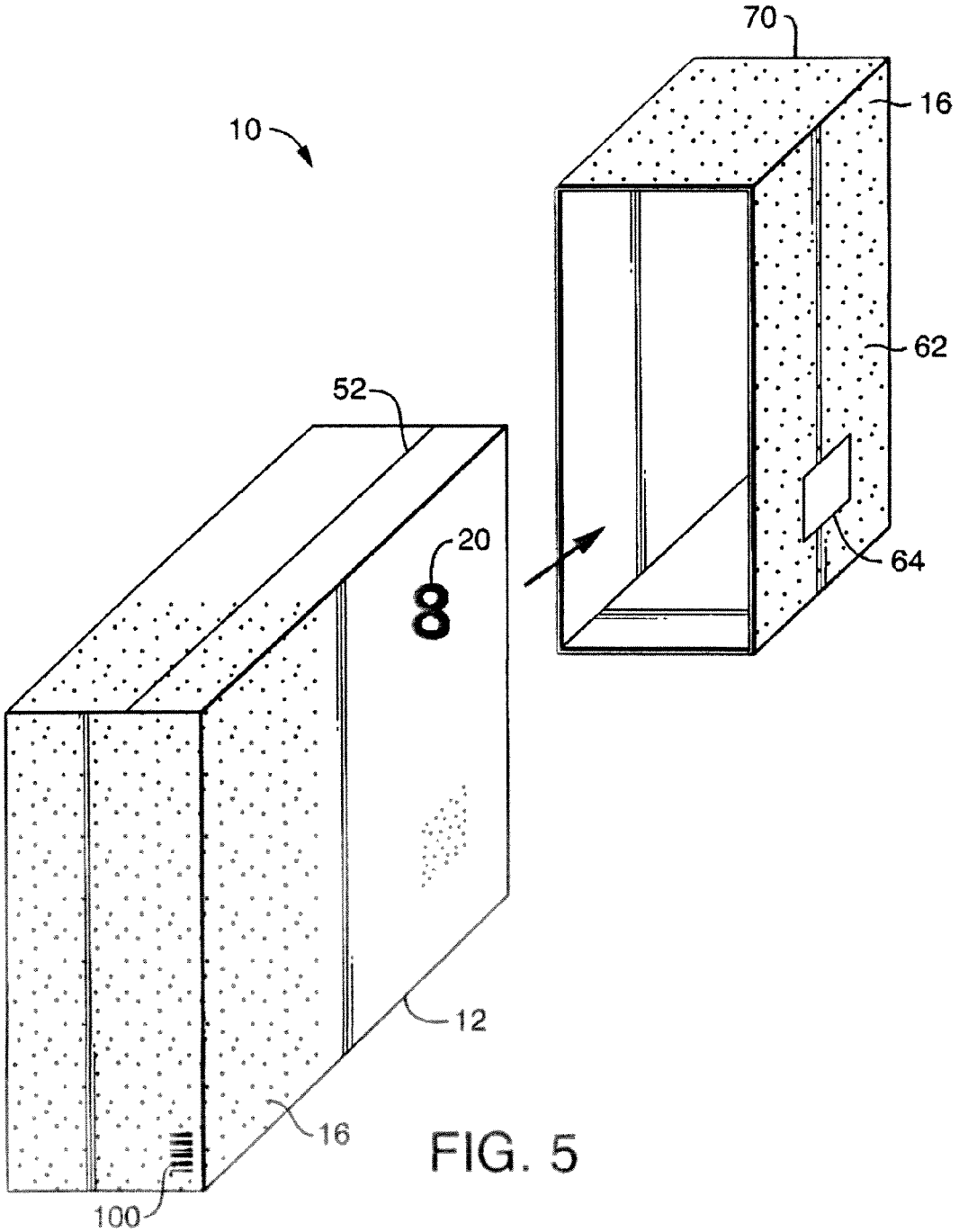
FIG. 5 is a representative perspective view of the packaging system of the present disclosure illustrating a translatable sleeve concealment element.

In still another aspect of the present disclosure illustrated in FIG. 5, the concealment element 28 is a tubular sleeve 70 that is open on two ends. The sleeve 70 is slid over the package 12 to circumscribe the exterior surface of the package 12 and is held in place by a friction fit with the package 12. The sleeve 70 is positionable by translating the sleeve 70 along the package 12 in a direction perpendicular to the plane of the package circumference 32. In the illustrated aspect, the sleeve 70 extends less than the width of the package 12 in a vertical configuration, but the sleeve 70 can extend more or less than that, or can be positioned in a horizontal configuration. Any other suitable configuration can be used.

In this aspect, the sleeve 70 has an opaque section 62 and a window 64 typically made from either opaque and clear films or from paper with openings, respectively, such that, in any position, the sleeve 70 obscures parts of the package 12 and allows viewing of other parts of the package 12. To complement the sleeve 70, the package 12 has alternating portions of product identifying graphics 20 and of a nondescript aesthetic surface configuration 16. The opaque section 62 of the sleeve 70 typically includes a nondescript aesthetic surface configuration 16. In addition, the sleeve 70 can be temporarily secured to the package 12 for transport and retail sale using breakable or perforated tape, adhesive, or any other suitable means.

To configure the packaging system 10 for retail sales, the sleeve 70 is positioned such that the window 64 of the sleeve 70 is aligned to overlie the product identifying graphics 20 on the package 12 while the opaque section 62 of the sleeve 70 overlies the nondescript aesthetic surface configuration 16 of the package 12.

To configure the packaging system 10 for discretion, a consumer simply holds the side of the package 12 and pulls or slides the sleeve 70 along the package 12. As the sleeve 70 is being positioned by the consumer, the sleeve 70 translates along the package 12, allowing the opaque section 62 of the sleeve 70 to cover the product identifying graphics 20 on the package 12, thus concealing the nature of the products in the package 12. Re-positioning the sleeve 70 can also allow the nondescript aesthetic surface configuration 16 of the package 12 to become visible in the window 64 of the sleeve 70. A zippered or perforated opening 52 can be located on any accessible side of the package 12 to allow product dispensing with or without the sleeve 70 attached.

Figure 6:
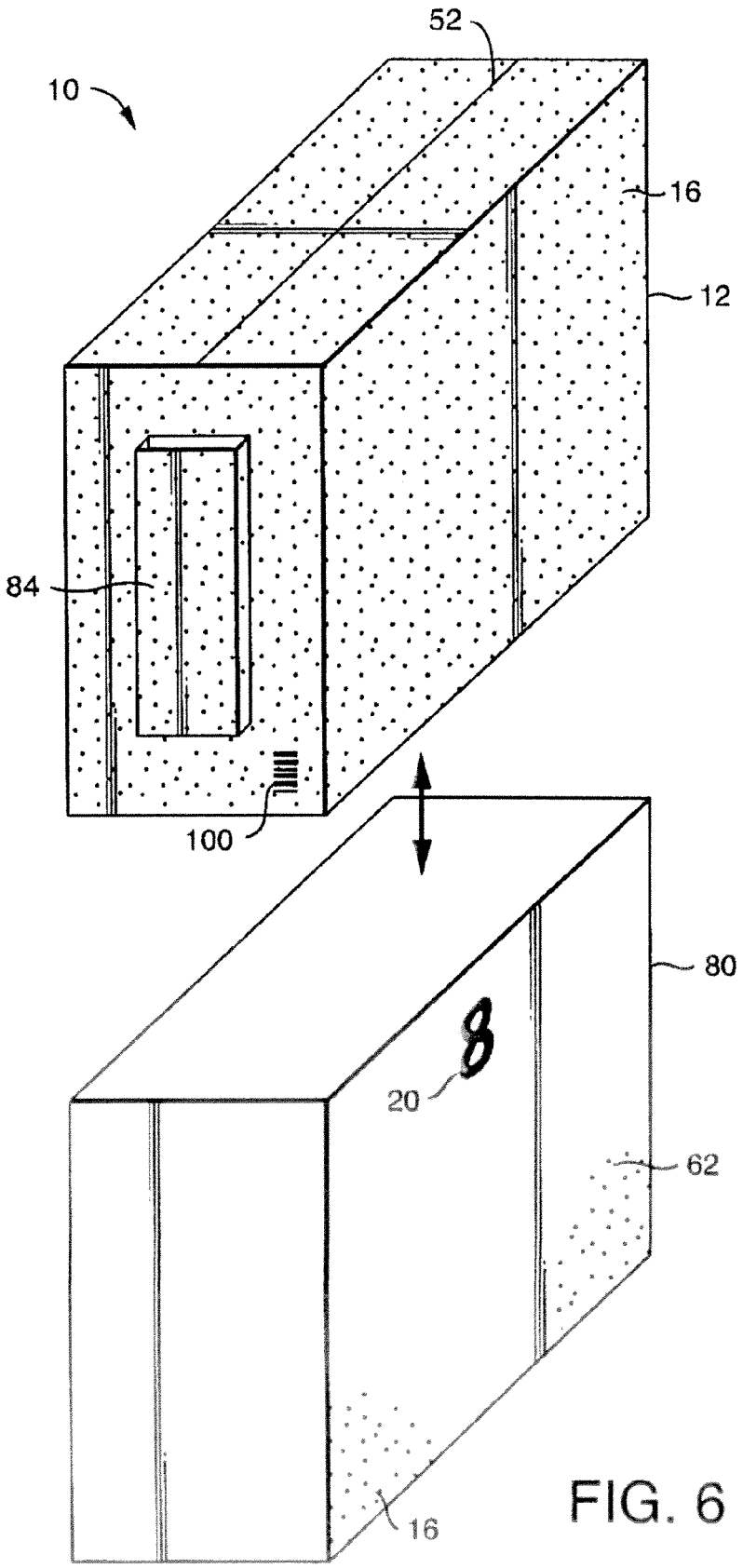
FIG. 6 is a representative perspective view of the packaging system of the present disclosure illustrating a cover concealment element.
Figure 7:
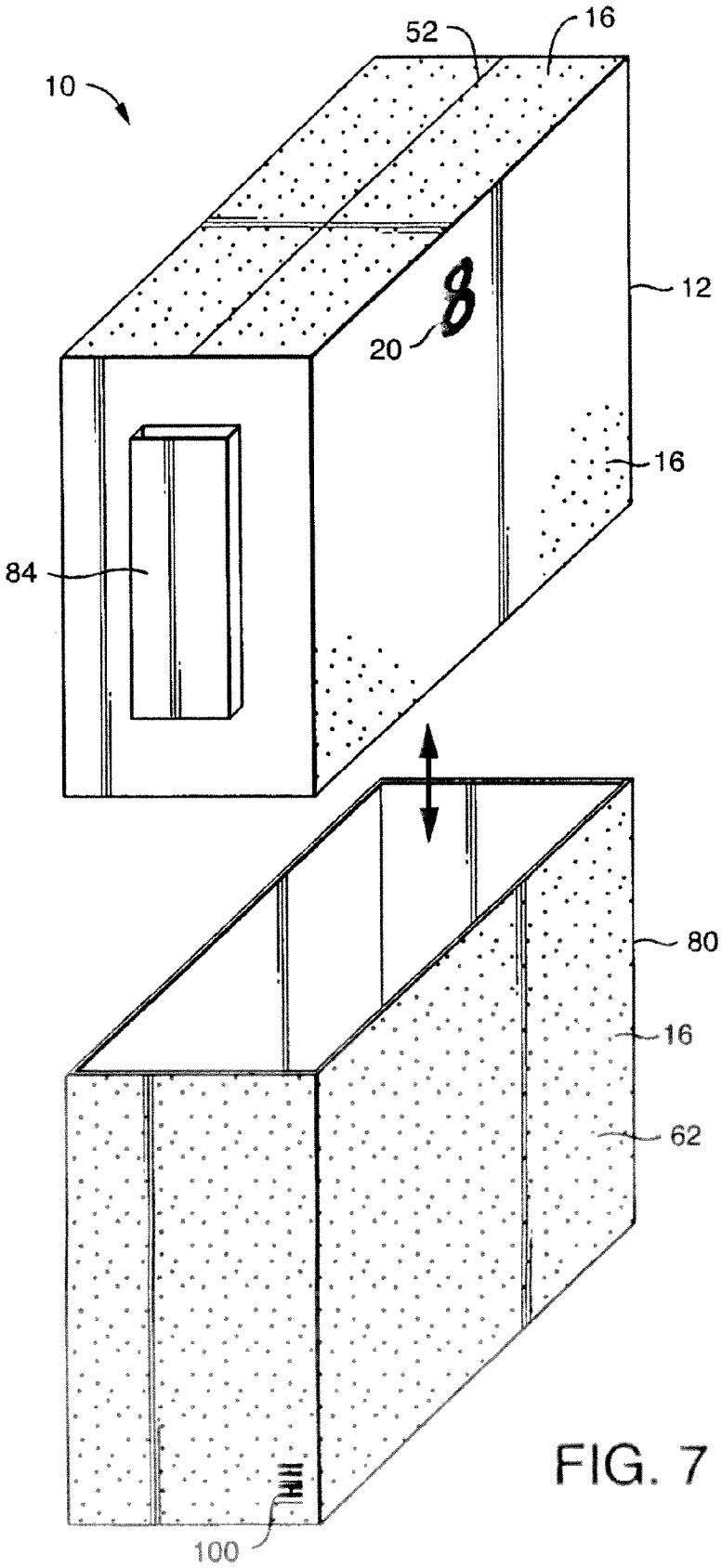
FIG. 7 is a representative perspective view of the packaging system of the present disclosure illustrating another aspect of a cover concealment element.

In yet another aspect of the present disclosure illustrated in FIGS. 6 and 7, the concealment element 28 is a cover 80 that is open on one end. The cover 80 is disposed over the package 12 to enclose some or all of the exterior surface of the package 12. The cover 80 can be held in place by a friction fit with the package 12 or by the use of tapes, adhesives, or by any other suitable means. The cover 80 is positionable by removing the cover 80 from the package 12. In the illustrated aspect, the cover 80 is extendible across the entire width, height, and depth of the package 12.

In this aspect, the cover 80 has primarily opaque sections 62, although the cover 80 can also include windows (not shown). The cover 80 can be made from film, paper, paperboard, or any other suitable material. Generally, as illustrated in FIG. 6, the cover 80 will include product identifying graphics 20 and can also include a nondescript aesthetic surface configuration 16. The package 12 will generally include entirely or primarily a nondescript aesthetic surface configuration 16.

To configure the packaging system 10 for retail sales, the cover 80 is positioned on and over the package 12 such that the package 12 appears to be adorned with product identifying graphics 20, which are actually disposed on the cover 80.

To configure the packaging system 10 for discretion, a consumer simply removes the cover 80 from the package 12, thus removing the product identifying graphics 20 and leaving a nondescript aesthetic surface configuration 16. In this aspect, the configuring for discretion is typically performed by the consumer after purchasing the package 12, although the configuration for discretion can also be performed in the retail setting by the consumer. To facilitate discretion, particularly in a retail setting, the package 12 can include a receiver 84 such as a pocket, opening, or flap in or under which the cover 80 can be placed and thereby hidden. A zippered or perforated opening 52 can be located at any suitable place on the package 12 to allow product dispensing once the cover 80 is removed.

Conversely, in an alternative aspect illustrated in FIG. 7, the cover 80 can include primarily a nondescript aesthetic surface configuration 16, with the product identifying graphics 20 disposed on the package 12. To configure the packaging system 10 for retail sale, the cover 80 is positioned in the receiver 84 such as a pocket, opening, or flap in or under which the cover 80 is placed and thereby hidden. The cover 80 can also be folded and removably attached to the package 12 using tape, adhesive, or any other suitable means. To configure the packaging system 10 for discretion, a consumer simply removes or detaches the cover 80 from its storage position and positions the cover 80 on and over the package 12 such that the package 12 appears to be adorned with a nondescript aesthetic surface configuration 16.

Figure 8:
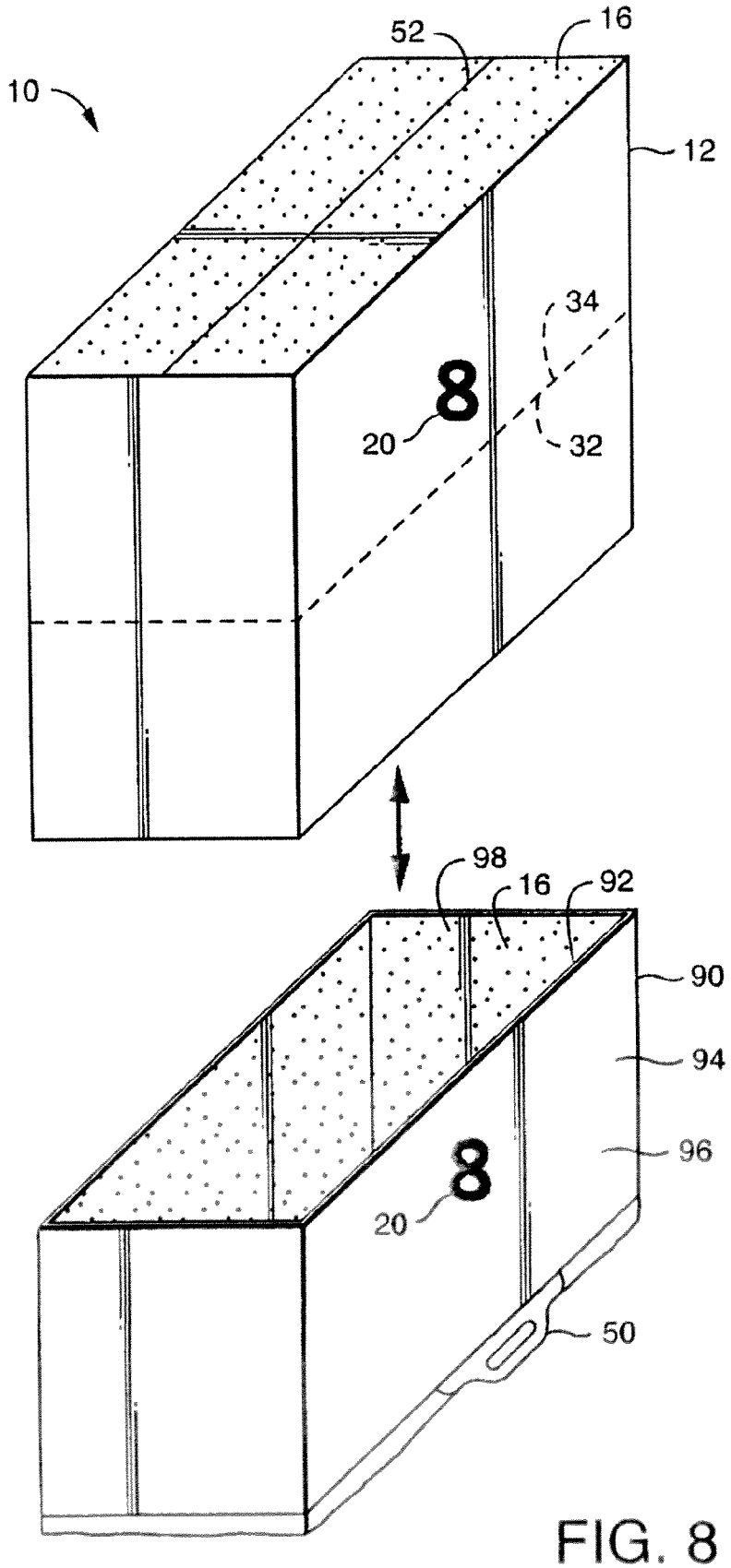
FIG. 8 is a representative perspective view of a packaging system of the present disclosure illustrating a tote bag concealment element.
Figure 9:
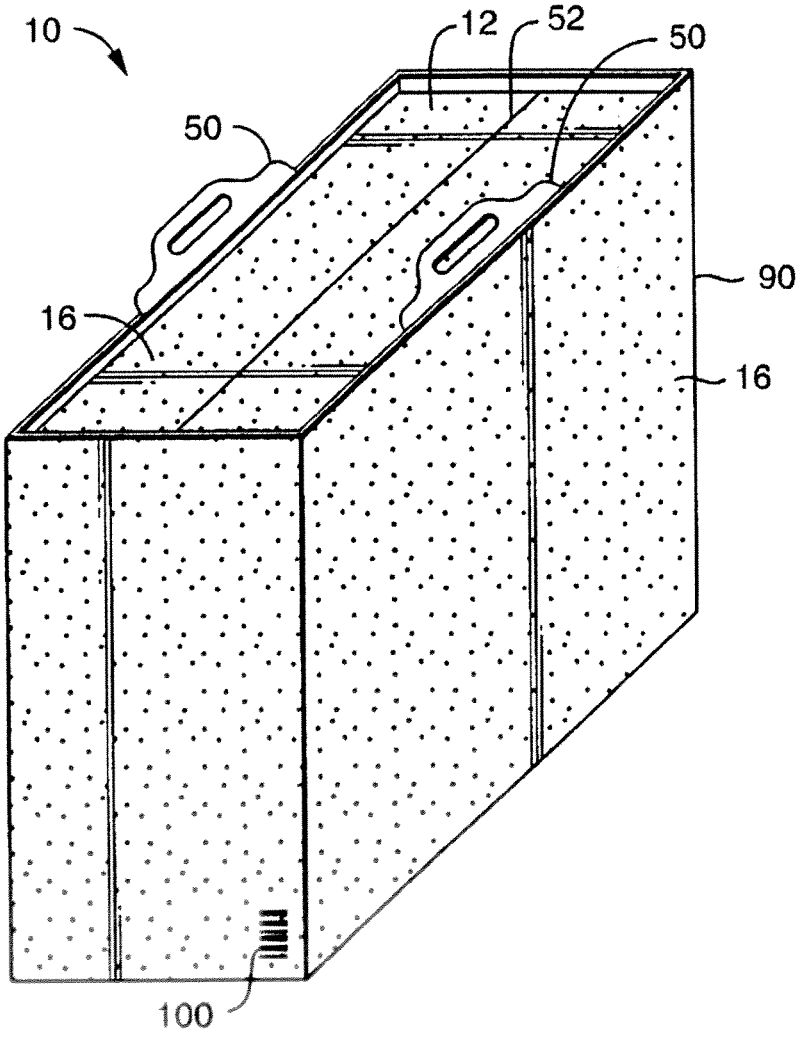
FIG. 9 is a representative perspective view of the packaging system of FIG. 8 particularly illustrating the repositionable concealment element.

In another aspect of the present disclosure illustrated in FIGS. 8 and 9, the concealment element 28 is a tote bag 90 enclosing a section of the exterior surface of the package 12, including at a horizontal package circumference 34. In the illustrated aspect, the package circumference 32 is located approximately midway along the height of the package 12, although any other suitable configuration can be used. The tote bag 90 can be held in place by a friction fit with the package 12 or by the use of tapes, adhesives, or by any other suitable means. The nature of the connection between the tote bag 90 and the package 12 forms a package circumference fold 92 that allows a folded portion 94 of the tote bag 90 to hingedly move or invert between a downward position and an upward position.

The tote bag 90 can be manufactured from material that is the same as or that is different from that of the package 12. The tote bag 90 can be removable from the package 12 at any convenient time to re-use for shopping or storage to improve the sustainability of the product packaging. In addition, and similarly to the cover 80 described above, the tote bag 90 can be stored in a receiver (not shown) such as a pocket or the like prior to concealment or after concealment, if concealment means removing the tote bag 90 from the package 12.

In this aspect, the folded portion 94 of the tote bag 90 has a first side 96 that can have any manner of product identifying graphics 20 printed thereon. Such product identifying graphics 20 can be the sole product identifying graphics 20 on the packaging system 10 or can be in addition to any product identifying graphics 20 on the package 12. The product identifying graphics 20 on the first side 96 of the folded portion 94 can be a continuation of the product identifying graphics 20 on the package 12. The totality of the product identifying graphics 20 adequately describes and identifies the personal care products contained within the package 12. Referring to FIG. 8, the tote bag 90 is positionable on the package 12 in a first position such that the first side 96 is outwardly facing and any product identifying graphics 20 are readily visible to a potential consumer. The tote bag 90 is held against the exterior surface of the package 12 in the first position by the friction fit caused by the circumscription of the tote bag 90 about the package 12.

Further to this aspect, the folded portion 94 of the tote bag 90 has an opposite or second side 98 having a nondescript aesthetic surface configuration 16 thereon. As with the nondescript aesthetic surface configuration 16 of the package 12, the nondescript aesthetic surface configuration 16 of the second side 98 can be any pattern, color, etc. that provides a generally pleasing aesthetic visual appearance without giving any noticeable indication of the personal care products carried within the package 12. Referring to FIG. 9, the folded portion 94 of the tote bag 90 is positionable on the package 12 by a consumer to the second position by sliding the folded portion 94 of the tote bag 90 along the package 12, hinging on the package circumference fold 92, such that the second side 98 is outwardly facing and any product identifying graphics 20 are hidden from the consumer and any others who might see the package 12. Again, the tote bag 90 is held against the exterior surface of the package 12 in the second position by the friction fit caused by the circumscription of the tote bag 90 about the package 12.

Conversely, in an alternative aspect not shown but that is similar to the cover aspect shown in FIG. 7, the tote bag 90 can include primarily a nondescript aesthetic surface configuration 16, with the product identifying graphics 20 disposed on the package 12. To configure the packaging system 10 for retail sale, the tote bag 90 is positioned in the receiver such as a pocket, opening, or flap in or under which the tote bag 90 is placed and thereby hidden. The tote bag 90 can also be folded and removably attached to the package 12 using tape, adhesive, or any other suitable means. To configure the packaging system 10 for discretion, a consumer simply removes or detaches the tote bag 90 from its storage position and positions the tote bag 90 over the package 12 such that the package 12 appears to be adorned with a nondescript aesthetic surface configuration 16.

In this tote bag aspect, positioning of the folded portion 94 of the tote bag by the consumer, and transport of the package 12, can be aided by the addition of one or more handles 50 to the folded portion 94 of the tote bag 90. The handles 50 can be folded up, down, or in as desired and further can be removably attached to the package 12 or the tote bag 90 using light adhesive or by other suitable means if desired. In addition or alternatively, the tote bag 90 can include a closure mechanism such as a drawstring, a hook and loop fastener, or any other suitable closure mechanism.

To configure the packaging system 10 for discretion, a consumer can conceal the contents of the package 12 by inverting the folded portion 94 of the tote bag 90 by grasping the package 12 and the handle 50 or the unattached end of the folded portion 94 and inverting the folded portion 94 over the package 12. As this is done, the nondescript aesthetic surface configuration 16 of the folded portion 94 and the tote bag 90 is revealed. A zippered or perforated opening 52 can be located at the top of the package 12, immediately below the unattached end or the handles 50 with the folded portion 94 in the second position, to allow product dispensing with or without the folded portion 94 inverted.

In any aspect described herein, the packaging system 10, even when the concealment element 28 is in the second position, can include any necessary purchasing indicia 100 such as a bar code such that the purchasing indicia 100 are visible when the concealment element 28 is in the second position. The purchasing indicia 100 can be provided on one or both of the package 12 and the concealment element 28. It may be desired to provide purchasing indicia 100 at a location on the package 12 that is not covered by the concealment element 28 in either of its positions. In this manner, the packaging system 10 can be accurately scanned or priced at the checkout counter or point of purchase without having to reposition the concealment element 28 back to its first position.

In addition, in any aspect described herein, it can be advantageous to size the concealment element 28 such that it is somewhat larger than the package 12 or portion of a package 12 it is intended to cover to allow for freedom of movement of the concealment element 28. This can also be accomplished by selecting a material for the concealment element 28 that can stretch somewhat for a good fit.

Further, in any aspect described herein, the packaging system 10 can exhibit decoy product-identifying graphics instead of or in addition to a nondescript aesthetic surface configuration 16, particularly when the concealment element 28 is in the second position. Decoy product-identifying graphics can be used when a blank or otherwise unlabeled package 12 might draw attention. The decoy product-identifying graphics can refer to a false or real, seemingly innocuous product that would garner little attention, such as dish towels, potato chips, bathroom tissue, home décor items or designs, a gift package, or anything that might typically be available in a similarly-sized box. To configure the packaging system 10 for retail sales, the concealment element 28 in the first position would still allow the packaging system 10 to exhibit the correct product identifying graphics 20. To configure the packaging system 10 for discretion, however, a consumer would re-position the concealment element 28 to the second position, thus revealing the decoy product-identifying graphics. The packaging system 10, even when the concealment element 28 is in the second position, would still need to include any necessary purchasing indicia 100 identifying the correct product as described above.

In other aspects of the present disclosure, it is understood that the disclosure includes a positionable concealment element 28 associated with a package 12 of products to selectively alter the exterior appearance of the package 12 so as to conceal the package contents. The concealment element 28 can be attached by any permanent or temporary means and can be flipped, rotated, or unfolded to conceal identifying graphics necessary for retail. The concealment element 28 can be made of any flexible material including plastic film, paper, or a combination thereof.

Aspects of the disclosure have been described with reference to various specific and illustrative aspects and techniques. However, it should be understood that many variations and modifications can be made while remaining within the spirit and scope. Accordingly, this is intended to embrace all such alternatives, modifications and variations that fall within the spirit and scope of the appended claims. As various changes could be made in the above constructions and methods, without departing from the scope of the disclosure, it is intended that all matter contained in the above description and shown in the accompanying drawings shall be interpreted as illustrative and not in a limiting sense.

When introducing elements of the disclosure or the preferred aspect(s) thereof, the articles "a", "an", "the" and "said" are intended to mean that there are one or more of the elements. The terms "comprising," "including," and "having" are intended to be inclusive and mean that there can be additional elements other than the listed elements.

What is claimed is:

1. A packaging system for personal care products, the system comprising:

a. a package configured for receipt of personal care products therein, the package comprising an external surface, a receiver positioned on the external surface of the package, a package circumference, a package height, a package width, and a package depth; and b. a concealment element positionable between a first position in which the packaging system exhibits product-identifying graphics and a second position in which the concealment element circumscribes the package and the package circumference and the packaging system is substantially bereft of product-identifying graphics, wherein the concealment element is a cover that is open at one end and wherein the cover is stored within the receiver when the packaging system is in the first position.

2. The packaging system of claim 1 wherein the cover is held in place by a friction fit with the package.

3. The packaging system of claim 1 wherein the cover is held in place by the use of a tape or an adhesive.

4. The packaging system of claim 1 wherein the cover is extendible across the entire width, entire height, and entire depth of the package.

5. The packaging system of claim 1 wherein the cover includes an opaque section.

6. The packaging system of claim 1 wherein the cover has a product identifying graphic and a nondescript aesthetic surface configuration.

7. The packaging system of claim 6 wherein the package has a nondescript aesthetic surface configuration.

8. The packaging system of claim 1 wherein the cover has a nondescript aesthetic surface configuration.

9. The packaging system of claim 8 wherein the package has a product identifying graphic.

* * * * *